United States Patent [19]

Higashi et al.

[11] Patent Number: 5,043,694

[45] Date of Patent: Aug. 27, 1991

[54] RESISTANCE ELEMENT AND METHOD FOR TRIMMING RESISTANCE ELEMENT

[75] Inventors: Shigeki Higashi; Tetsuya Murakawa, both of Nagaokakyo, Japan

[73] Assignee: Murata Manufacturing Co., Ltd., Japan

[21] Appl. No.: 359,209

[22] Filed: May 31, 1989

[30] Foreign Application Priority Data

Jun. 1, 1988 [JP] Japan ..... 63-134953

[51] Int. Cl.[5] ..... H01C 10/10

[52] U.S. Cl. ..... 338/195; 29/610.1

[58] Field of Search ..... 338/195; 219/121.68, 219/121.69; 29/610.1

[56] References Cited

U.S. PATENT DOCUMENTS 4,429,298 1/1984 Oberholzer ..... 338/195

4,434,416 2/1984 Schonberger ..... 338/195 X

*Primary Examiner*—Marvin M. Lateef

*Attorney, Agent, or Firm*—Ostrolenk, Faber, Gerb & Soffen

[57] ABSTRACT

A resistance element includes a resistance film formed between a pair of electrodes. A trimming groove is formed in the resistance film by means of a laser beam, whereby a resistance film portion which is electrically independent from the resistance film is formed. The trimming groove is formed between a start point and an end point which are both positioned at the outside edge of the resistance film, and the trimming groove includes a first portion which is started at the start point and curved (convex) toward one electrode, a second portion which is started at an end of the first portion and extended in a direction parallel with a line connecting the electrodes, and a third portion which is started at an end of the second portion and terminated at the end point and curved toward the other electrode. Therefore, the electrically independent resistance film portion is formed in the shape of an elongated circle. In the electrically independent resistance film portion, a further trimming groove intersecting the line connecting the electrodes is formed.

10 Claims, 4 Drawing Sheets

RESISTANCE ELEMENT AND METHOD FOR TRIMMING RESISTANCE ELEMENT

BACKGROUND OF THE INVENTION

1. Field of the invention

The present invention relates to a resistance element which constitutes a part of a hybrid IC, a chip resistor, etc., and includes a resistance film formed between a pair of electrodes on an insulating substrate, and a method for trimming such a resistance element.

2. Description of the prior art

FIG. 6 through FIG. 10 are illustrative views showing different examples of a conventional resistance element, respectively.

FIG. 6 shows a resistance element in which a resistance film 3 is formed between a pair of electrodes 1 and 2 on an insulating substrate (not shown) and a resistance value between the electrodes 1 and 2 is trimmed or adjusted by forming a linear trimming groove 4 in the resistance film 3. FIG. 7 shows a resistance element in which an L trimming groove 5 is formed in the resistance film 3 to trim or adjust the resistance value. In the resistance elements shown in FIG. 6 and in FIG. 7, a start point SP of the trimming groove is positioned at the outside of the resistance film 3, but an end point EP thereof exists within the resistance film 3. Therefore, a microcrack is susceptible to occur at a portion of the resistance film 3 in the vicinity of the end point EP. Therefore, when a large surge current flows between the electrodes 1 and 2, heat is locally generated by current concentration at the portion in the vicinity of the end point EP, which causes micro-crack which has been formed in trimming to become larger, and resultingly a, large change of the resistance value takes place.

In order to eliminate such a disadvantage, in Japanese Patent Application Laid-open No. 107806/1985 laid-open on June 13, 1985, a trimming method shown in FIG. 8 or FIG. 9 has been proposed. In FIG. 8, the start point SP and the end point EP are both positioned at the outside the resistance film 3 and a trimming groove 6 which is continued between the start point SP and the end point EP in a form of a circular arc is formed, whereby a resistance film portion 3*a*, which is independent of the resistance film 3 which extends between the electrodes 1 and 2, is formed. In addition, in FIG. 9, a trimming groove 7 is formed between the start point SP and the end point EP which are both positioned at the outside of the resistance film 3, which includes a first portion 7*a* which is extended from the start point SP in a direction orthogonally intersecting a line connecting the electrodes 1 and 2, a second point 7*b* which is started at an end of the first portion 7*a* and curved toward the same direction in a form of a circular arc and a third portion 7*c* which is started at an end of the second portion 7*b* and terminated at the end point EP and extended a direction opposite to the extending direction of the first portion 7*a*.

In the example shown in FIG. 8 or FIG. 9, a current flows between the electrodes 1 and 2 through a current path CP as shown by a dotted line. Therefore, in the example, since the current flows so as to intersect the trimming groove 6 or 7, at any portion of the trimming groove 6 or 7, change of the resistance value is large, and therefore, it is difficult to finely or precisely trim or adjust the resistance value In addition, in Japanese Patent Application Laid-open No. 133504/1980 laid-open on Oct. 17, 1980, a resistance element as shown in FIG. 10 has been proposed. In an example as shown in FIG. 10, a trimming groove 8 is formed between the start point SP and the end point EP which are both positioned at the outside of the resistance film 3. The trimming groove 8 includes a first portion 8*a* which is started at the start point SP and extended in a direction orthogonally intersecting a line connecting the electrodes 1 and 2, a second portion 8*b* which is started at an end of the first portion 8*a* and extended in a direction parallel with the line connecting the electrodes 1 and 2, and a third portion 8*c* which is started at an end of the second portion 8*b* and extended toward the end point EP in a direction orthogonally intersecting the line connecting the electrodes 1 and 2. In this example, since a connecting portion between the first portion 8*a* and the second portion 8*b* and a connecting portion between the second portion 8*b* and the third portion 8*c* are both formed at a right angle, a micro-crack is susceptible to occur at that portion. Furthermore, in the example, as in to the examples shown in FIG. 8 and FIG. 9, there is a disadvantage that it is difficult to finely or precisely trim or adjust the resistance value.

SUMMARY OF THE INVENTION

Therefore, it is a principal object to provide a novel resistance element.

Another object of the present invention is to provide a method for trimming a resistance element, wherein a resistance value can be finely or precisely trimmed or adjusted.

A resistance element in accordance with the present invention comprises a pair of electrodes; a resistance film formed between the pair of electrodes; and a trimming groove continued between a start point and an end point which are both positioned outside the resistance film, said trimming groove including a first portion which is started at the start point and curved toward one of the pair of electrodes, a second portion which is started at an end of the first portion and extended in a direction parallel with a line connecting the pair of electrodes, and a third portion which is started an end of the second portion and terminated at the end point and curved toward the other of the pair of electrodes.

In order to obtain such a resistance element, a resistance film is formed between a pair of electrodes and by irradiating a laser beam on the resistance film, a trimming groove is formed which extends from a start point outside the resistance film to an end point outside the resistance film. In forming the trimming groove, at first, a first portion which is started at the start point and curved toward one of the pair of electrodes is formed, and succeedingly, a second portion which is started at an end of the first portion and extended in a direction parallel with a line connecting the pair of electrodes is formed, and a third portion is lastly formed between the second portion and the end point to be curved toward the other of the pair of electrodes.

In accordance with the present invention, although change of a resistance value is large at the first portion of the trimming groove since the first portion intersects a current path between the pair of electrodes, the change of the resistance value becomes small at the second portion since the current path is in parallel with the second portion, and the change of the resistance value becomes further small at the third portion since the end point gradually becomes more distant from the current path. Therefore, in accordance with the present invention, in comparison with a resistance element according to any of the known prior art, it is easy to finely or precisely trim or adjust the resistance value. In addition, since the first portion and the second portion are respectively curved toward corresponding electrodes and these are interconnected by the second portion without forming a sharp corner or edge, no micro-crack is susceptible to be formed at any portion of the trimming groove. Even if such discharge occurs, therefore, the change of the resistance value does not become large.

In an embodiment in accordance with the present invention, in the resistance film portion which is formed by the above described trimming groove to be electrically independent from the resistance film which extends between the electrodes, a further trimming groove is formed, which is extended in a direction intersecting a line connecting the electrodes. By forming the further trimming groove, it is possible to reliably prevent a discharge from occurring between the resistance film and the resistance film portion through the first trimming groove.

The objects and other objects, features, aspects and advantages of the present invention will become more apparent from the following detailed description of the embodiments of the present invention when taken in conjunction with accompanying drawings.

DETAIL DESCRIPTION OF THE PREFERRED EMBODIMENTS

Figure 1:
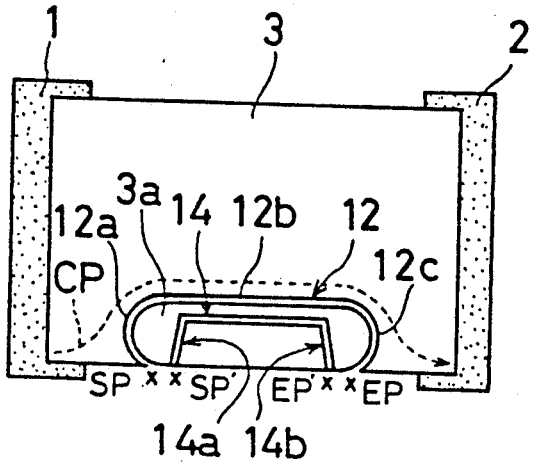
FIG. 1 is an illustrative view showing one embodiment in accordance with the present invention.

With reference to FIG. 1, on an insulating substrate (not shown) such as alumina and so on, a pair of electrodes 1 and 2 are formed opposite to each other by printing and firing Ag-Pd paste, for example. Between the electrodes 1 and 2, by printing and firing a resistance paste such as ruthenium oxide or the like, a resistance film 3 is formed. Such a resistance element constitutes a chip resistor or a portion of a hybrid IC.

In trimming the resistance element, a trimming groove 12 is formed in the resistance film 3 by irradiating a laser beam, for example. A start point SP and an end point EP of the trimming groove 12 are determined outside the resistance film 3. A trimming groove in a form of a circular arc is started at the start point SP and curved (convex) toward one electrode 1, which becomes a first portion 12*a* of the trimming grove 12. A second portion 12*b* is formed to be an extension of the first portion 12*a*. It is started at an end of the first portion 12*a* and extended in a direction parallel with a line connecting the electrodes 1 and 2. Thereafter, from an end of the second portion 12*b* to the end point EP, a third portion 12*c* in a form of a circular arc is formed to be curved (convex) toward the other electrode 2. By forming the trimming groove 12 which is continued from the start point SP to the end point EP, a resistance film portion 3*a* is formed in the shape of an elongated circle and electrically independent from the resistance film 3 connected between the electrodes 1 and 2.

Next, in the resistance film portion 3*a* which is electrically independent from the resistance film 3, a second trimming groove 14 is formed in the form of a trapezoid such that a start point SP' and an end point EP' of the trimming groove 14 are both positioned outside the resistance film portion 3*a*. The trimming groove 14 includes a first portion 14*a* and a second portion 14*b* which are both extended in a direction intersecting a line connecting the electrodes 1 and 2.

In the FIG. 1 embodiment, a current flows between the electrodes 1 and 2 through a current path CP as shown by a dotted line. Therefore, change of the resistance value becomes relatively large at the first portion 12*a* of the trimming groove 12 since the first portion 12*a* intersects the current path CP, but the change of the resistance value becomes small at the second portion 12*b* since the second portion 12*b* is in parallel with the current path CP, and at the third portion 12*c*, although the third portion 12*c* intersects the current path CP, the change of the resistance value becomes even smaller since the third portion 12*c* gradually becomes more distant from the current path CP. Therefore, at the second and the third portions 12*b* and 12*c*, the rate of change of the resistance value with respect to predetermined length of the trimming groove 12 becomes small, and thus it is easy to make a fine or precise trimming or adjustment of the resistance value.

In addition, the connecting portion of the groove 12 between the first portion 12*a* and the second portion 12*b* and the connecting portion between the second portion 12*b* and the third portion 12*c* are both gently curved and no sharp corner or edge is formed at that portion, and therefore, there is no possibility that a micro-crack is formed at that portion. Therefore, if a discharge occurs at the first portion 12*a* and the second portion 12*b*, the change of the resistance value due to the discharge does not become large.

The shape of the second trimming groove which is formed in the resistance film portion 3*a*, which independent from the resistance film 3, is not limited with an example of FIG. 1 embodiment and may have a shape as shown in any of FIG. 2 through FIG. 5.

Figure 2:
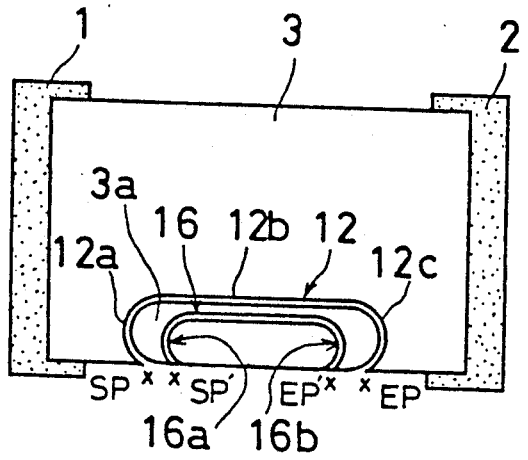
FIG. 2 through FIG. 5 are illustrative views showing different modified examples of the FIG. 1 embodiment, respectively.
Figure 3:
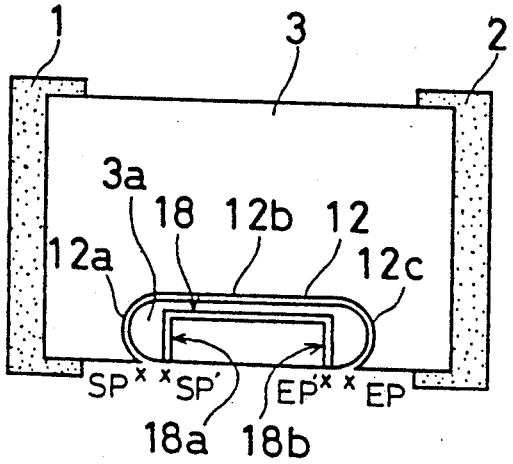
Figure 4:
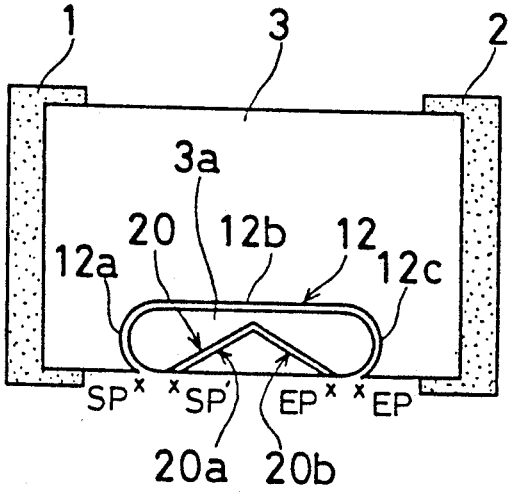
Figure 5:
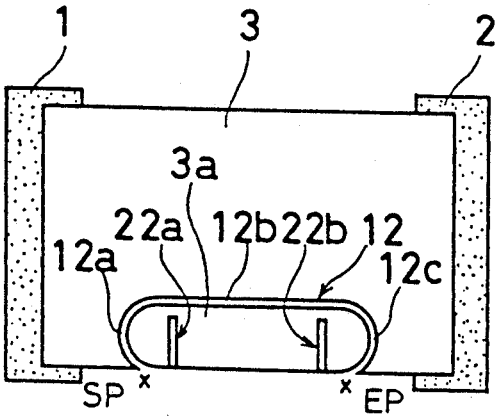
Figure 6:
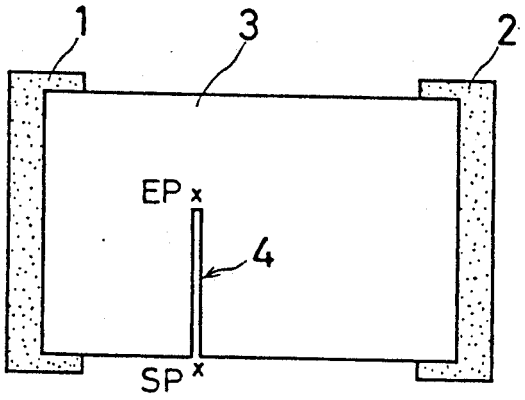
FIG. 6 PRIOR ART
Figure 7:
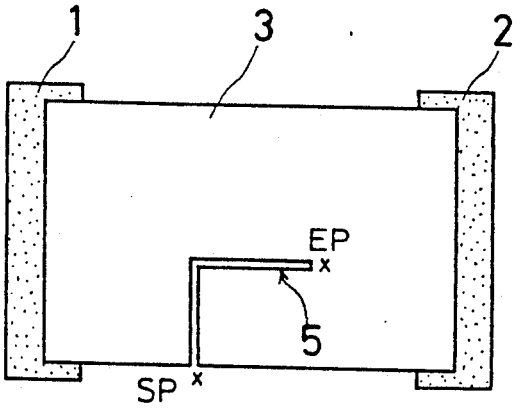
FIG. 7 PRIOR ART
FIG. 7 through FIG. 10 are illustrative views showing conventional resistance elements and methods for trimming the same, respectively.
Figure 8:
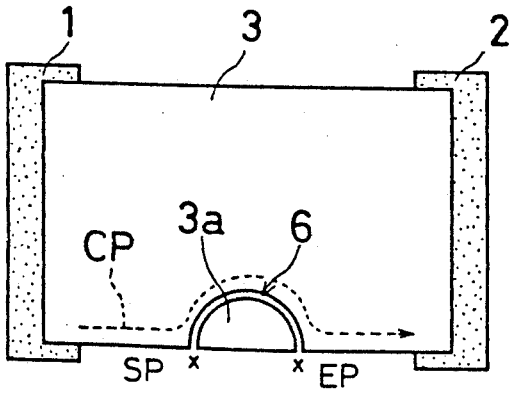
FIG. 8 PRIOR ART
Figure 9:
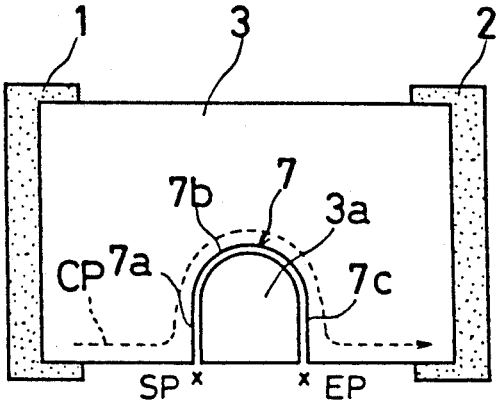
FIG.9 PRIOR ART
Figure 10:
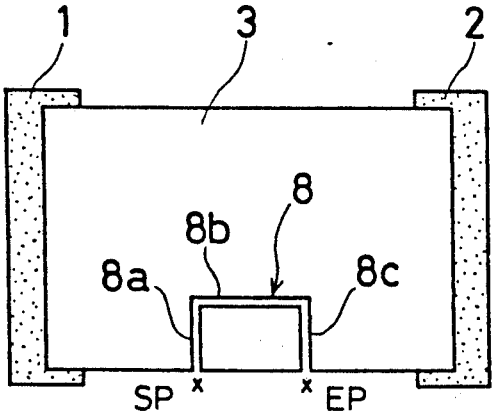
FIG.10 PRIOR ART

In FIG. 2 example, in the resistance film portion 3*a*, trimming groove 16 has a figure similar to the figure of the trimming groove 12 and has portions 16*a* and 16*b* intersecting a line connecting the electrodes 1 and 2. In FIG. 3 example, in the resistance film portion 3*a*, a rectangular trimming groove 18 having portions 18*a* and 18*b* intersecting a line connecting the electrodes 1 and 2 is formed. In the FIG. 4 example, a V-shaped trimming groove 20 having portions 20*a* and 20*b* intersecting a line connecting the electrodes 1 and 2 is formed in the resistance film portion 3*a*. In the FIG. 5 example, in the resistance film portion 3*a*, trimming grooves 22*a* and 22*b*, each intersecting a line connecting the electrodes 1 and 2 are formed. Thus, by forming a trimming groove or grooves in the resistance film portion 3*a*, it is possible to effectively prevent the discharge between the resistance film 3 and the resistance film portion 3*a* through the trimming groove 12.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A resistance element, comprising:

a pair of electrodes;

a resistance film formed between said pair of electrodes; and a trimming groove formed in said resistance film extending between a start point and an end point which are both positioned outside said resistance film, said trimming groove including a first portion which is started at the start point and curved toward one of said pair of electrodes, a second portion which is started at an end of said first portion and extended in a direction parallel with an imaginary line connecting said pair of electrodes, and a third portion which is started at an end of said second portion and terminated at the end point and curved toward the other of said pair of electrodes, and said trimming groove forming a resistance film portion which is electrically independent from said resistance film.

2. A resistance element in accordance with claim 1, further comprising a further trimming groove formed in said resistance film portion and intersecting an imaginary line connecting said pair of electrodes.

3. A resistance element in accordance with claim 1, wherein the start point and the end point of the trimming groove are both at an edge of said resistance, film said edge extending between the pair of electrodes;

said first trimming groove portion being curved convexly toward said one of said pair of electrodes and extending transverse to a substantially straight imaginary line connecting said pair of electrodes;

said second trimming groove portion extending in a direction parallel with said substantially straight imaginary line connecting said pair of electrodes; and said third trimming groove portion extends transverse to said substantially straight imaginary line connecting said pair of electrodes and being curved convexly toward said other of said pair of electrodes.

4. A resistance element in accordance with claim 2, wherein said substantially straight imaginary line connecting said pair of electrodes is substantially perpendicular to at least one of said electrodes.

5. A resistance element in accordance with claim 3, wherein said substantially straight imaginary line extends generally in the direction of a current path between said pair of electrodes.

6. A method of trimming a resistance element having a resistance film formed between a pair of electrodes, comprising the steps of:

(a) determining a start point outside said resistance film, and forming a first trimming groove portion to be started at said start point and curved toward one of said pair of electrodes;

(b) forming second trimming groove portion to be started at an end of said first trimming groove portion and extended in a direction parallel with an imaginary line connecting said pair of electrodes; and (c) forming a third trimming groove portion to be started at an end of said second trimming groove portion and curved toward the other of said pair of electrodes, and determining an end point of said third trimming groove portion outside said resistance film, said first, second and third trimming groove portions forming a resistance film portion which is electrically independent from said resistance film.

7. A method in accordance with claim 6, further comprising the step of (d) forming a trimming groove intersecting an imaginary line connecting said pair of electrodes in said resistance film portion.

8. A method in accordance with claim 6, wherein the start point and end point are both at an edge of said resistance film, said edge extending between the pair of electrodes;

said first trimming groove portion being curved convexly toward said one of said pair of electrodes and extending transverse to a substantially straight imaginary line connecting said pair of electrodes;

said second trimming groove portion extending parallel with said substantially straight imaginary line connecting said pair of electrodes; and said third trimming groove portion extends in a direction transverse to said substantially straight imaginary line connecting said pair of electrodes and being curved convexly toward said other of said pair of electrodes.

9. A method in accordance with claim 8, wherein said substantially straight imaginary line connecting said pair of electrodes is substantially perpendicular to at least one of said electrodes.

10. A method in accordance with claim 8, wherein said substantially straight imaginary line extends generally in the direction of a current path between said pair of electrodes.

* * * * *